US011305402B2

(12) United States Patent
Bronzino

(10) Patent No.: US 11,305,402 B2
(45) Date of Patent: Apr. 19, 2022

(54) CLAMPING DEVICE, IN PARTICULAR A VICE

(71) Applicant: OML srl, Siccomario (IT)

(72) Inventor: Walter Bronzino, Turin (IT)

(73) Assignee: OML SRL, Travaco (IT)

( * ) Notice: Subject to any disclaimer, the term of this patent is extended or adjusted under 35 U.S.C. 154(b) by 15 days.

(21) Appl. No.: 16/751,874

(22) Filed: Jan. 24, 2020

(65) Prior Publication Data

US 2020/0238478 A1 Jul. 30, 2020

(30) Foreign Application Priority Data

Jan. 28, 2019 (EP) ..... 19153891

(51) Int. Cl.
*B25B 1/10* (2006.01)
*B25B 1/02* (2006.01)
(Continued)

(52) U.S. Cl.
CPC ..... *B25B 1/103* (2013.01); *B25B 1/02* (2013.01); *B25B 1/2489* (2013.01); *B25B 5/02* (2013.01); *B25B 5/102* (2013.01); *B25B 5/166* (2013.01)

(58) Field of Classification Search
CPC ..... B25B 1/02; B25B 1/103; B25B 1/2489; B25B 5/02; B25B 5/102; B25B 5/166; B25B 1/10; B25B 1/24; B25B 1/2478
(Continued)

(56) References Cited

U.S. PATENT DOCUMENTS 5,649,694 A * 7/1997 Buck ..... B25B 1/2405 269/154
6,206,354 B1 * 3/2001 Lin ..... B25B 1/103 269/136
(Continued)

FOREIGN PATENT DOCUMENTS

DE 575 658 C 5/1933
DE 575658 C * 5/1933 ..... B25B 1/06
(Continued)

OTHER PUBLICATIONS

DE-575658-C translation Espacenet (Year: 2021).*
EP-0742081-A2 translation Espacenet (Year: 2021).*

*Primary Examiner* — Joseph J Hail
*Assistant Examiner* — Timothy Brady
(74) *Attorney, Agent, or Firm* — Pandiscio & Pandiscio

(57) ABSTRACT

In a clamping device (1), in particular vice, the clamping device comprising:

a housing (2) which is U-shaped in cross-section and in which one or two guideways (8) extending in a linear direction are incorporated, at least one base jaw (11) which is mounted in the guideway (8) and in which an internal thread (12) is provided, and a drive spindle (9) which is rotatably mounted in the respective housing (2), is arranged parallel to the guideway (8) and is drivably coupled to the respective base jaw (11), the threads (10) worked into the drive spindle (9), through which the torques from the crank are transmitted for the linear displacement of the base jaws (11), should be permanently encapsulated in a watertight and airtight manner irrespective of the position of the base jaws (11) or the drive spindle (9), and on the other hand the adjustment travel (Δs) of the base jaws (11) or clamping jaws (13) should be as
(Continued)

large as possible in order to clamp workpieces with configurations that can be completely different without the need for time-consuming and complicated conversion measures. This is achieved in that a right-hand thread and a left-hand thread (10) are worked onto the drive spindle (9) in regions, in that the respective thread (10) of the drive spindle (9) is enclosed or encapsulated by a cover sleeve (21), in that the cover sleeve (21) has a right-hand thread and a left-hand internal thread (22), which are drivably coupled to the respective thread (10) of the drive spindle (9), in that a right-hand and a left-hand external thread (23), which is in engagement with the respective internal thread (12) of the base jaw (11), is worked on to the cover sleeve (21).

14 Claims, 13 Drawing Sheets

(51) Int. Cl.
*B25B 1/24* (2006.01)
*B25B 5/02* (2006.01)
*B25B 5/10* (2006.01)
*B25B 5/16* (2006.01)

(58) Field of Classification Search
USPC ..... 269/156, 45, 43, 246; 74/89.23, 74/89.32–89.35
See application file for complete search history.

(56) References Cited

U.S. PATENT DOCUMENTS 8,052,130 B2 * 11/2011 Huang ..... B25B 1/18 269/244
2004/0173041 A1 * 9/2004 Said ..... F16H 25/2056 74/89.35
2006/0049566 A1 * 3/2006 Bernstein ..... B25B 1/2489 269/43
2006/0081078 A1 * 4/2006 Nagai ..... F16H 25/2015 74/89.23
2010/0192715 A1 * 8/2010 Vauchel ..... F16H 25/20 74/89.35
2010/0206103 A1 * 8/2010 Duits ..... H02K 7/06 74/89.34
2011/0316212 A1 12/2011 Jones et al.
2012/0297908 A1 * 11/2012 Bourgoine ..... F16H 25/20 74/89.23
2013/0133448 A1 * 5/2013 Schroeder ..... F16H 25/2006 74/89.32
2013/0152716 A1 * 6/2013 Buvril ..... F16H 25/2252 74/89.23
2013/0283947 A1 * 10/2013 Yamada ..... F16H 25/2021 74/89.23
2014/0020488 A1 * 1/2014 Koch ..... F16B 37/043 74/89.35
2014/0021667 A1 * 1/2014 Wang ..... B25B 1/103 269/20
2014/0131933 A1 * 5/2014 Taylor ..... B25B 1/24 269/165
2014/0290403 A1 * 10/2014 Wu ..... F16H 25/2056 74/89.35
2015/0135868 A1 * 5/2015 Nikolaev ..... F16F 1/32 74/89.34
2015/0316112 A1 * 11/2015 Yamasaki ..... F16H 25/2252 188/162
2015/0343606 A1 * 12/2015 Lin ..... B25B 1/103 269/153
2016/0023329 A1 * 1/2016 Schlussel ..... B25B 1/2489 269/242
2017/0001284 A1 * 1/2017 Maggert ..... B25B 1/103
2018/0272499 A1 * 9/2018 Cheng ..... B25B 1/02
2019/0389036 A1 * 12/2019 Taylor ..... B25B 1/2484

FOREIGN PATENT DOCUMENTS

DE 10 2009 024 005 A1 12/2010
EP 0 742 081 A2 11/1996
EP 0742081 A2 * 11/1996 ..... B25B 1/18
GB 191102286 A * 11/1911 ..... B25B 1/103

* cited by examiner

CLAMPING DEVICE, IN PARTICULAR A VICE

REFERENCE TO PENDING PRIOR PATENT APPLICATION

This patent application claims benefit of European Patent Application No. 19 153 891.7, filed Jan. 28, 2019, which patent application is hereby incorporated herein by reference.

FIELD OF THE INVENTION

The invention relates to a clamping device, in particular a vice.

BACKGROUND OF THE INVENTION

Clamping devices have been well known for decades and are successfully used to support workpieces to be machined. The clamping devices usually have one or two clamping jaws mounted in a housing between which the workpiece to be machined can be clamped. One of the two clamping jaws can also be provided as a stationary component of a vice housing. The clamping jaws are drivably coupled to a drive spindle and the rotation of the drive spindle is converted into a linear and synchronous feed movement of the clamping jaws.

In order to be able to adapt the clamping width of the clamping jaws individually to the geometry of the workpieces to be clamped, the clamping jaws are often attached to a base jaw, for example by means of screws, so that the clamping jaws can be mounted at different positions on the upper side of the base jaw, meaning that the specified distance can be set.

Each base jaw is slideably inserted in a linear guide groove which is worked into two parallel side walls in the housing. In order to be able to move the base jaws back and forth, they are connected to a drive spindle. The drive spindle has a thread for each base jaw which engages in an internal thread incorporated into the base jaws, so that when the drive spindle is turned and the base jaws are linearly guided in the housing, the base jaws shift axially relative to the housing in its longitudinal direction. The drive spindle, for example, can be manually operated from the outside by means of a crank and can be turned clockwise or counterclockwise depending on the desired positioning of the clamping jaws.

The drive spindle is rotatably mounted in the housing and runs coaxially to the longitudinal axis of the housing, i.e. with an equally large lateral distance to the guide grooves for the base jaws in the inner wall of the housing. However, the drive spindle in the housing cannot be displaced or moved due to its bearing on the housing, but can also perform a rotational movement. The pitches of the thread pairs are identical, but have an opposite direction, so that when the drive spindle is turned, a synchronous feed movement for the base jaws and clamping jaws occurs.

It has been found to be a disadvantage with clamping devices of this kind that the threads between the drive spindle and the base jaws are contaminated by coolants or lubricants and by chips or other particles produced during the machining of the workpiece, or even that the thread pairings become seized, since the chips that have penetrated block the relative movement between the two threads of the drive spindle and the base jaws. Although this problem has been recognised, the solutions of prior art have only provided for partial encapsulation of the threads, so that one or more of the threads are freely accessible, particularly in the case of an extremely external or internal position of the base jaws relative to the housing and its central axis, and this means contaminants or chips can penetrate into them.

In addition, the positions of the clamping jaws or the base jaws can be quickly adapted to the geometry of the workpieces to be clamped without complex retooling measures. However, since the workpieces can have considerably different overall lengths, it is necessary to replace the base jaws and/or the clamping jaws when converting between extremely small workpieces and vice versa. Such conversion times, however, are time-consuming and since the vices need to have a high repeat accuracy with regard to workpieces of the same size, these conversion measures require new calibrations or measurements of the vice.

For certain clamping conditions, different modes of operation of the clamping devices are also necessary. The clamping devices of prior art, in particular vices, either have two base jaws or clamping jaws that move towards one another or away from one another synchronously, or one of the clamping jaws or base jaws serves as a stop and the opposite clamping jaw moves to clamp a workpiece onto it. Consequently, only one workpiece can be reliably held between two clamping jaws in such vices. As soon as several workpieces are to be machined or locked at the same time, they must have an identical length. Workpieces of different sizes cannot be clamped simultaneously in one of the vices of prior art.

SUMMARY OF THE INVENTION

It is therefore the task of the present invention to further develop a clamping device of the aforementioned type in such a way that, on the one hand, the threads worked into the drive spindle, through which the torques from the crank are transmitted for the linear displacement of the base jaws, are permanently encapsulated in a watertight and airtight manner irrespective of the position of the base jaws or the drive spindle, and on the other hand the adjustment travel of the base jaws or clamping jaws is as large as possible in order to clamp workpieces with configurations that can be completely different without the need for time-consuming and complicated conversion measures.

In addition, the clamping device according to the present invention should make it possible for the user to have two workpieces of different sizes held simultaneously by the clamping device in a position-oriented and self-centring manner and that one of the base or clamping jaws serves as a stop for the workpiece to be clamped and only the opposite base or clamping jaw can be moved relative to the housing.

These tasks are solved according to the present invention by the features of the characterising part of patent claim 1.

Further advantageous embodiments of the present invention are derived from the subordinate claims.

In that a right-hand thread and a left-hand thread are worked onto the drive spindle in regions, in that the respective thread of the drive spindle is enclosed or encapsulated by a cover sleeve, in that the cover sleeve has a right-hand internal thread and a left-hand internal thread which is drivably coupled to the respective thread of the drive spindle, in that the cover sleeve is provided with a right-hand external thread and a left-hand external thread which is in engagement with the respective internal thread of the base jaw, the result is that the threads between the drive spindle and the base jaw are permanently encapsulated in the housing, i.e. sealed watertight and airtight, irrespective of the position of the base jaw.

In addition, the base jaws can be moved or arranged in different positions relative to their distance from the central axis of the housing, so that, on the one hand, workpieces of different sizes are simultaneously inserted between one of the clamping jaws and the stop and, on the other hand, one of the clamping jaws serves as a stop for the workpiece to be machined. The necessary conversion measures can be carried out quickly and easily, as only a few components have to be replaced or one of the base jaws has to be fixed to the housing.

The fixing block to be fastened to the housing fixes the retaining ring fastened to the drive spindle so that the drive spindle is locked in relation to the longitudinal axis of the housing without the rotation of the drive spindle being hindered or restricted thereby. At the same time, the retaining ring is advantageously mounted exactly centrally between the two right-hand and left-hand threads of the drive spindle so that the synchronous infeed movements of the base jaws or clamping jaws causes a self-centring of the workpiece to be clamped because it is pushed to the opposite clamping jaw by the respective clamping jaw which first contacts the workpiece until it comes into contact with the workpiece to be clamped. Consequently, workpieces of different sizes can be clamped in a self-centring manner on the clamping devices without calibrations or other check measurements having to be carried out. Thus, the clamping device according to the present invention represents a so-called zero point clamping system.

As soon as the fixing block has been removed, the drive spindle can be moved relative to the longitudinal axis of the housing, because it is mounted on the housing exclusively via the cover sleeves and the respective base jaw. Accordingly, a stop can be provided in alignment with the central axis of the housing, by means of which two clamping sections are formed with the clamping jaw arranged opposite to it in each case. Consequently, each of the two clamping jaws can press a workpiece against the stop. Since the length of the workpiece to be clamped determines the position of the respective clamping jaw relative to the housing and the drive spindle can be moved relative to the housing, a workpiece can be clamped between the respective clamping jaw and the stop, the length of which differs from that of the adjacent clamped workpiece. The position of the clamping jaw which contacts the longer dimensioned workpiece first is fixed by the workpiece and the drive spindle and the cover sleeve rotate further so that the adjacent clamping jaw can be moved further in the direction of the stop.

It is intended for a further embodiment of the clamping device according to the present invention to lock one of the base jaws to the housing by means of fastening screws, preferably the base jaw which is arranged furthest away from the crank. Consequently, the locked base jaw serves as a stop for the clamping jaw which is still mounted in the housing so that it can be displaced relative to the housing, with the result that a workpiece can be clamped between the two pairs of clamping jaws. The length of the workpiece indicates the position of the mobile clamping jaw. It is advantageous that the mobile clamping jaw can be advanced up to the fixed clamping jaw, as the drive spindle can be turned out of the housing so that the distance between the fixed and the freely movable clamping jaw can be completely overcome by turning the drive spindle.

BRIEF DESCRIPTION OF THE DRAWINGS

The drawings show three applications of a sample embodiment of a vice used as a clamping device, which are explained in more detail below. In the drawings.

DETAILED DESCRIPTION OF THE PREFERRED EMBODIMENTS

Figure 1:
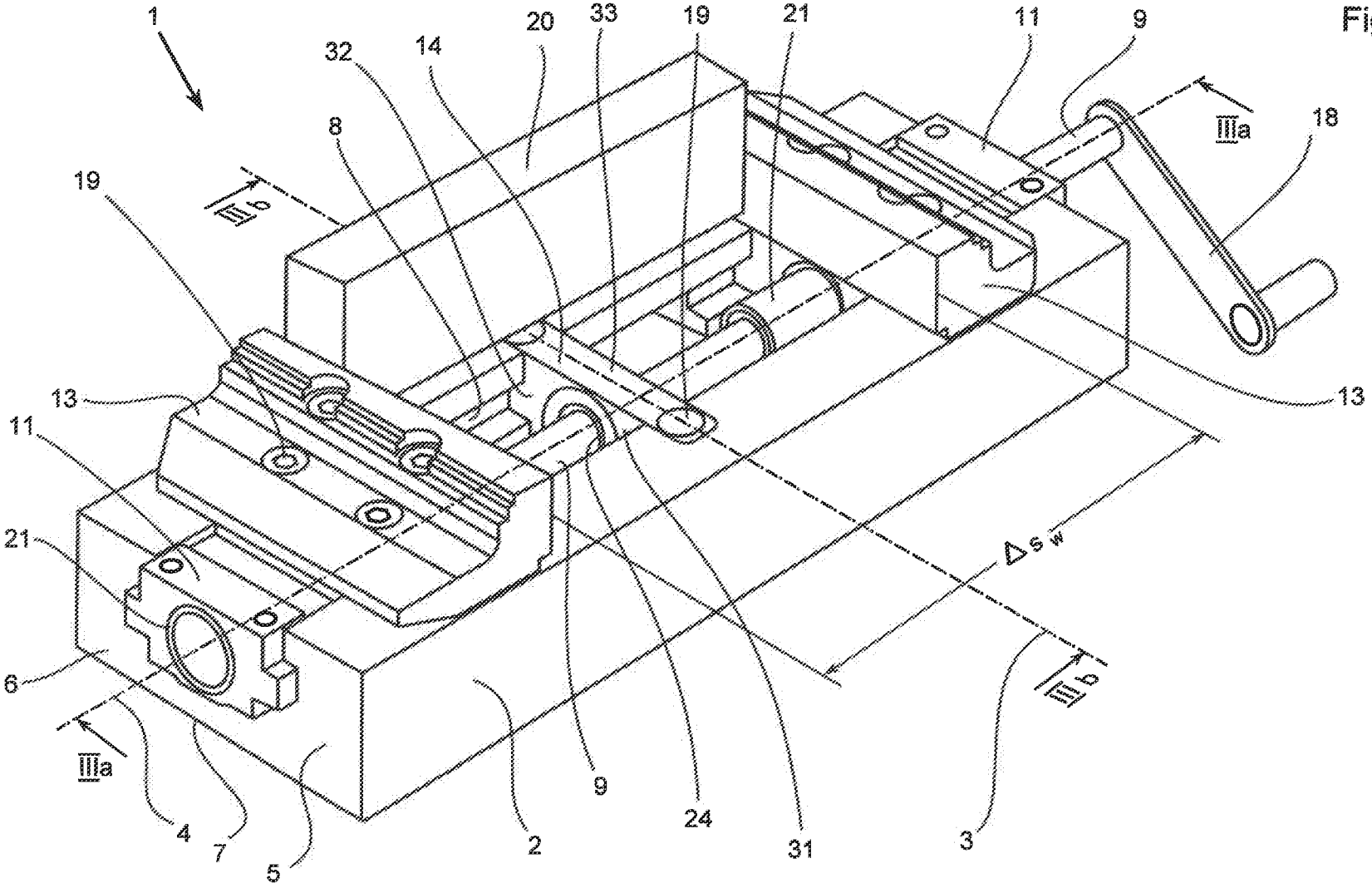
FIG. 1 shows a first application of a clamping device in the form of a vice, having a housing into which two guide tracks extending parallel to one another are incorporated, having two base jaws which are movably held in the guide grooves and in each case one clamping jaw fastened to the base jaw, having a drive spindle mounted in the interior of the housing and two cover sleeves partially encapsulating the drive spindle, and having a fixing block arranged in the central axis of the housing for fixing the drive spindle relative to the longitudinal axis of the housing, in perspective view.

FIG. 1 shows a clamping device 1 in the form of a vice. The clamping device 1 should hold a workpiece 20 in a position-oriented and self-centring position in space. This means that the axes of symmetry of the workpiece 20 are aligned coaxially with the central axis 3 formed by a housing 2 of the clamping device 1, i.e. this clamping position should be created for all workpieces 20, regardless of their length dimensions. The workpiece 20 fixed by the clamping device 1 is to be machined during the clamping state by a machine tool that is not shown. The vice 1 is therefore fixed to a tool table in a position-oriented manner and in order to achieve repeat accuracy when changing the workpieces 20, it is necessary for the position of the vice 1 in relation to the machine tool to be maintained and for the workpieces 20 supported on the vice 1 to assume an identical spatial position during the clamping state if they have an identical length.

The clamping device 1 consists of the housing 2 with a U-shaped cross-section. The housing 2 thus has two parallel legs 5 and 6 and a base or web 7 arranged between them. A guide groove 8 is worked into each of the two parallel legs 5 and 6, which are arranged in a common plane. The cross-section of the guide grooves 8 can be U-shaped, dovetail-shaped or T-shaped.

A base jaw 11 is inserted in the guide grooves 8, which is movable in and relative to the housing 2 and is mounted in the guide grooves 8. Several rows of threaded holes are provided on the upper side of the base jaw 11, into which fastening screws 19 can be screwed in order to fasten a clamping jaw 13 on the upper side of the base jaw 11 in each case. Thus, the clamping jaws 13 can be inserted at different positions on the base jaw 11, in which case initially the clamping width or the adjustment travel Δs of the clamping jaws 13 can be adjusted to the geometry of the workpiece 20.

A drive spindle 9 is provided which runs parallel to the two legs 5 and 6 and the web 7 of the housing 2 in order to linearly feed or slide apart the base jaws 11 and the clamping jaws 13 attached to them. One of the free ends of the drive spindle 9 protrudes from the housing 2, so that a crank 18 can be attached to this end of the drive spindle 9, which is freely accessible from the outside, in order to turn the drive spindle 9.

Figure 2:
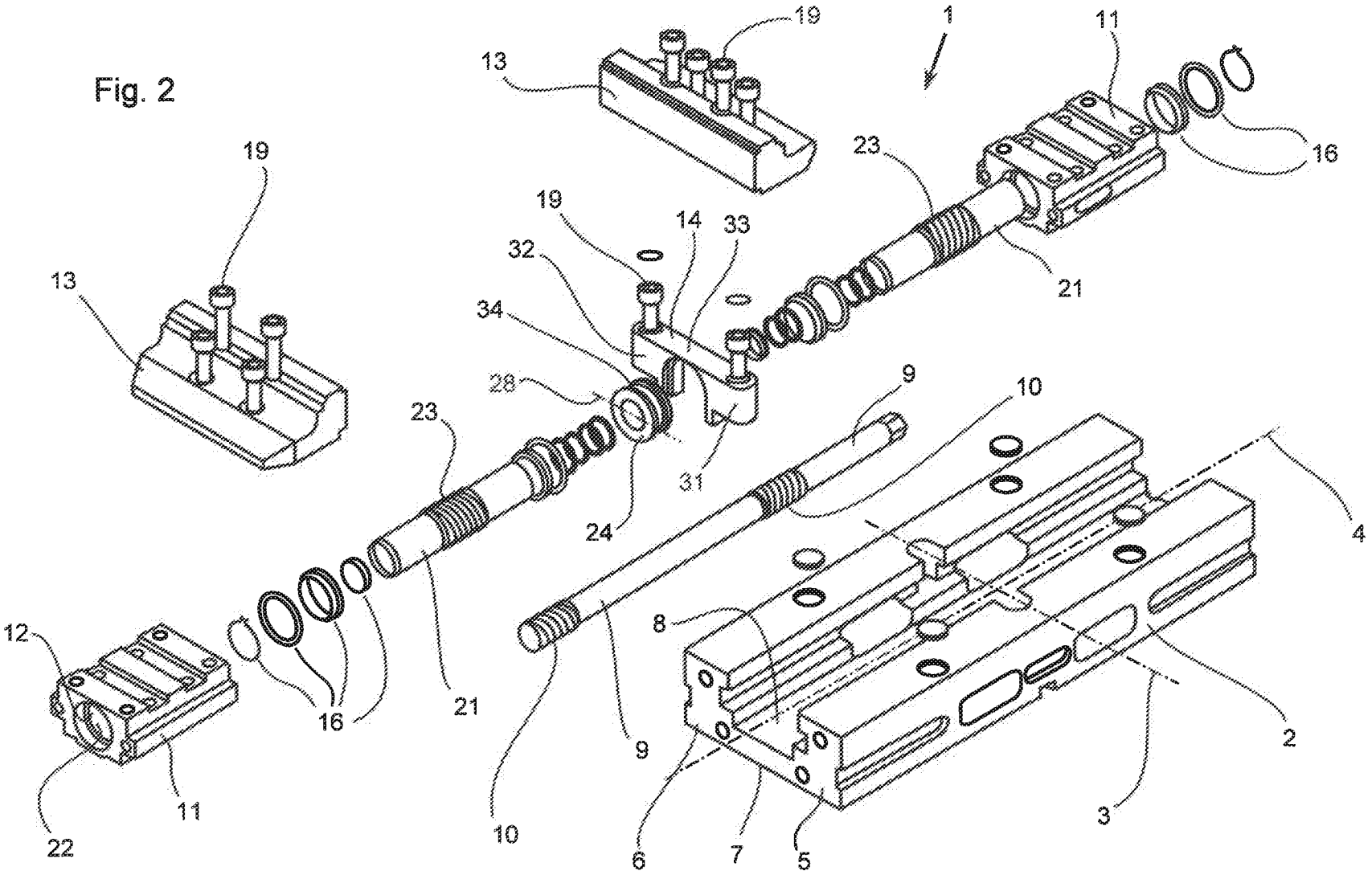
FIG. 2 shows the clamping device according to FIG. 1, with its individual parts in exploded view.

FIG. 2 in particular shows that two threads 10 have been worked into the drive spindle 9, the thread pitches of which are aligned in opposite directions. One of the threads 10 is therefore right-handed and the opposite thread 10 is left-handed. In the middle between these two threads 12 there is a retaining ring 24 attached to the outside of the drive shaft 9, which in the mounted state of the drive spindle 9 is exactly aligned with the central axis 3 of the housing 2.

The retaining ring 24 has an axis of symmetry 28 which, when the retaining ring 24 is mounted on the drive spindle 9, is aligned with the central axis 3. The self-centring of the clamping device 1 is achieved by the position of the retaining ring 24, because the retaining ring 24 is positioned exactly in the middle between the two right-hand and left-hand threads 10 of the drive spindle 9.

In addition, two cover sleeves 21 are provided, some of which are pushed onto the drive spindle 9 and by means of which the threads 10 of the drive spindle 9 are completely enclosed to the outside or sealed water/airtight. In order to fasten the retaining ring 24 to the drive spindle 9 in the correct position, it is necessary for the cover sleeves 21 to be screwed onto the thread 10 of the drive spindle 9 and, if the cover sleeves 21 are moved towards each other manually until the respective end of the thread 10 is reached, the two cover sleeves 21 opposite each other hold the retaining ring 24 already pushed onto the drive spindle 9 exactly in the middle between them. The distance between the retaining ring 24 and the two cover sleeves 21 is therefore the same and the retaining ring 24 can be locked to the drive spindle 9 using fastening screws 19. In addition, a groove 34 is machined into the retaining ring 24. The axis of symmetry 28 of the retaining ring 24 is aligned with the centre of the groove 34.

From FIGS. 2, 3*a*, 4 and 5 it can be seen that each of the cover sleeves 21 has a right-hand and left-hand internal thread 22 which is in full or partial engagement with the respective right-hand or left-hand thread 10 which is worked onto the drive spindle 9. It is technically imperative that the right-hand thread 10 of the drive spindle 9 is assigned to a right-hand internal thread 22 of the cover sleeve 21 and the left-hand thread 10 of the drive spindle 9 is assigned to a left-hand internal thread 22 of the cover sleeve 21.

In addition, each of the cover sleeves 21 has a right- and left-hand external thread 23 which is in engagement with a thread 12 machined onto the base jaws 11. The same applies to the relationship between the respective external thread 23 of the cover sleeve 21 and the thread 12 in the respective base jaw 11 with regard to the respective direction of rotation of the thread pairs 23 and 12 formed in this way.

This creates a working connection between the drive spindle 9 and each of the cover sleeves 21 and between the cover sleeves 21 and the base jaws 11, as well as a mechanical coupling and bearing, by means of which the drive spindle 9 is rotatably supported on the housing 2. As a result, the rotation of the drive spindle 9 generated by the crank 18 is transferred to the cover sleeve 21 via the thread pairs 10 and 22. Whether the cover sleeve 21 is moved relative to the drive spindle 9 or relative to the base jaw 11 depends—as explained in more detail below—on the mechanical coupling between the cover sleeve 21 and the drive spindle 9 on the one hand and the cover sleeve 21 and the base jaw 11 on the other.

Figure 3A:
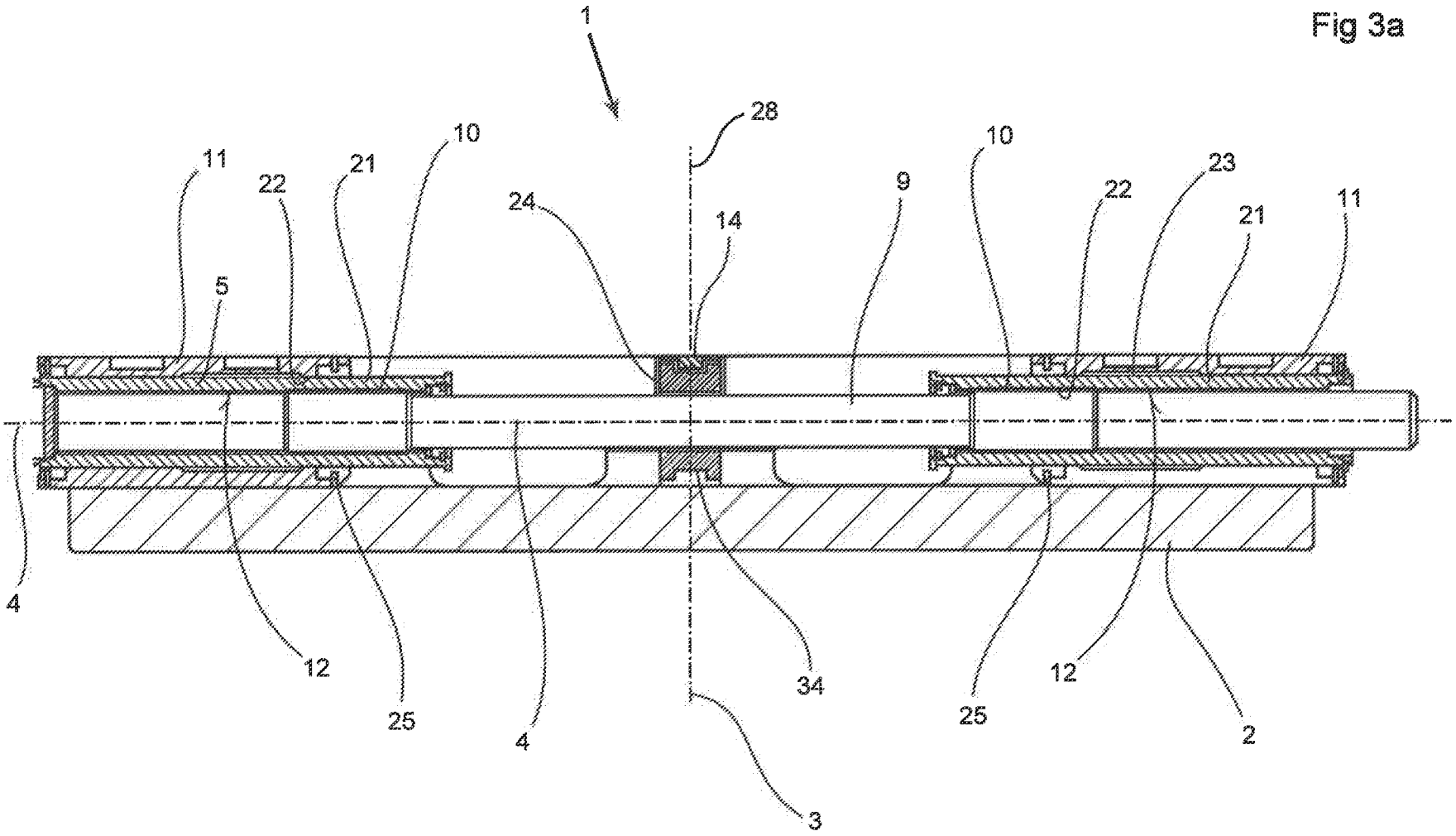
FIG. 3*a* shows the clamping device according to FIG. 1, along the section line IIIa-IIIa.
Figure 3B:
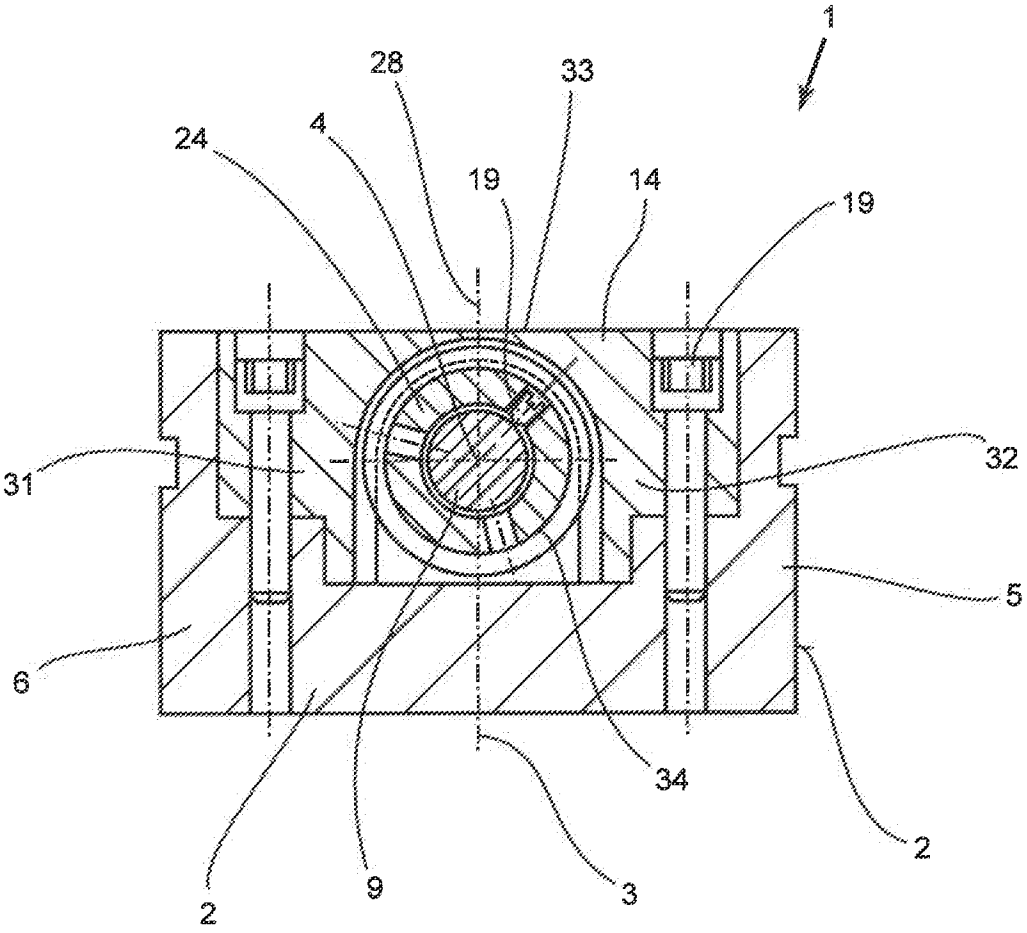
FIG. 3*b* shows the clamping device according to FIG. 1, along the section line IIIb-IIIb.

FIGS. 3*a* and 3*b* also show that a fixing block 14 can be fitted to the housing 2 using the fixing screws 19. The fixing block 14 is U-shaped in its cross-section. It thus consists of two parallel legs 31 and 32 and a web 33 arranged between them. The web 33 faces the open side of the housing 2 and the legs 31, 32 project into the inside of the housing 2, thus running in the area of the two parallel guideways 8.

When the fixing block 14 is mounted on the housing 2, the two legs 31, 32 and the web 33 grip the retaining ring 24, namely the legs 31, 32 and the web 33 engage in the groove 34 of the retaining ring 24. Accordingly, the position of the drive spindle 9 is fixed relative to the housing 2 via the retaining ring 24. The drive spindle 9 can therefore only rotate in the housing 2, but does not change its relative position to the housing 2 due to the locking of the fixing block 14 with the retaining ring 24.

If the retaining ring 24 is location at exactly the same distance from the respective beginning of the right-hand and left-hand threads 10 of the drive spindle 9 and the position of the drive spindle 9 is determined by means of the positive connection between the retaining ring 24 fastened to the drive spindle 9 and the fixing block 14, the workpiece 20 is aligned by the synchronous linear movement of the clamping jaws 13, which move towards each other, and the drive spindle 9 cannot be moved relative to the housing 2 in the longitudinal direction 4. Furthermore, the axis of symmetry 28 of the retaining ring is exactly aligned with the central axis 3, which ensures that each clamped workpiece 20 is aligned centrally with respect to the central axis 3. The web 33 projects centrally beyond the surface formed by the housing 2 so that the workpiece 20 can rest on this surface.

Figure 4:
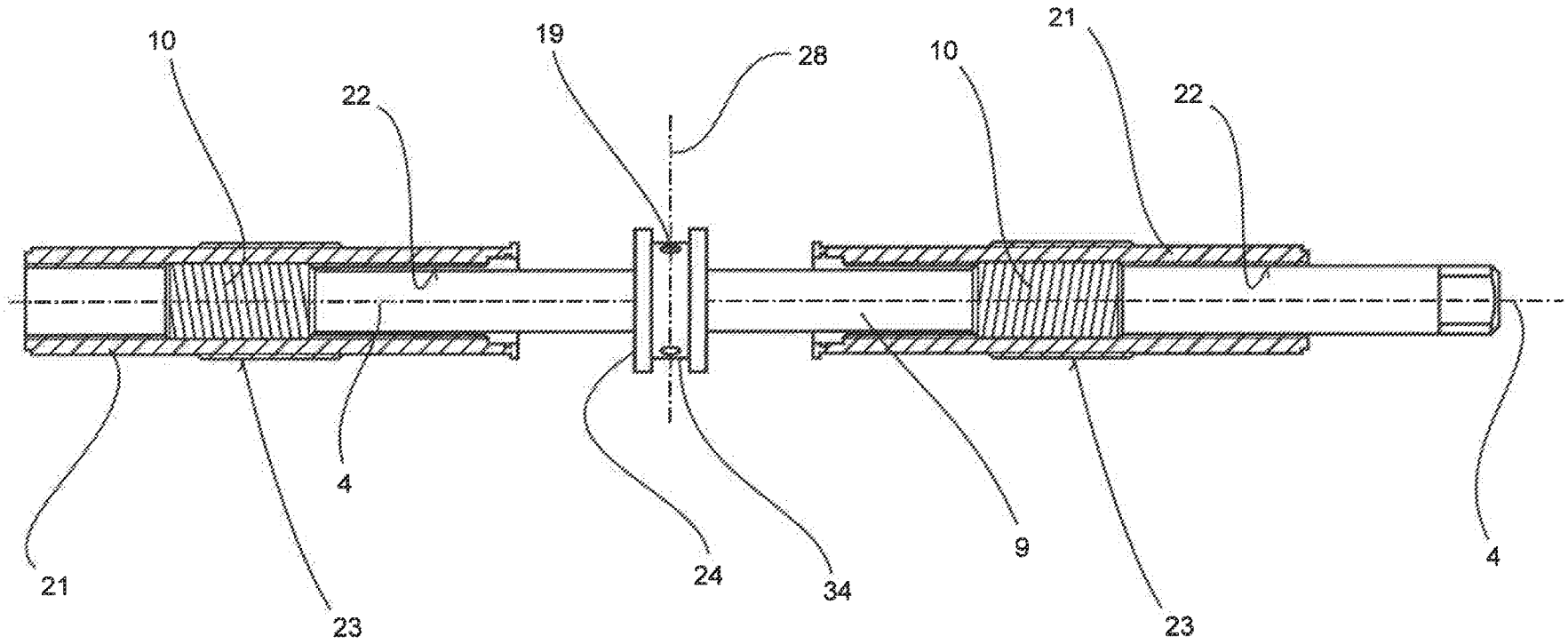
FIG. 4 shows the drive spindle according to FIG. 1, with two threads running in opposite directions and a stop assigned to the central axis of the housing of the clamping device, in side view.
Figure 5:
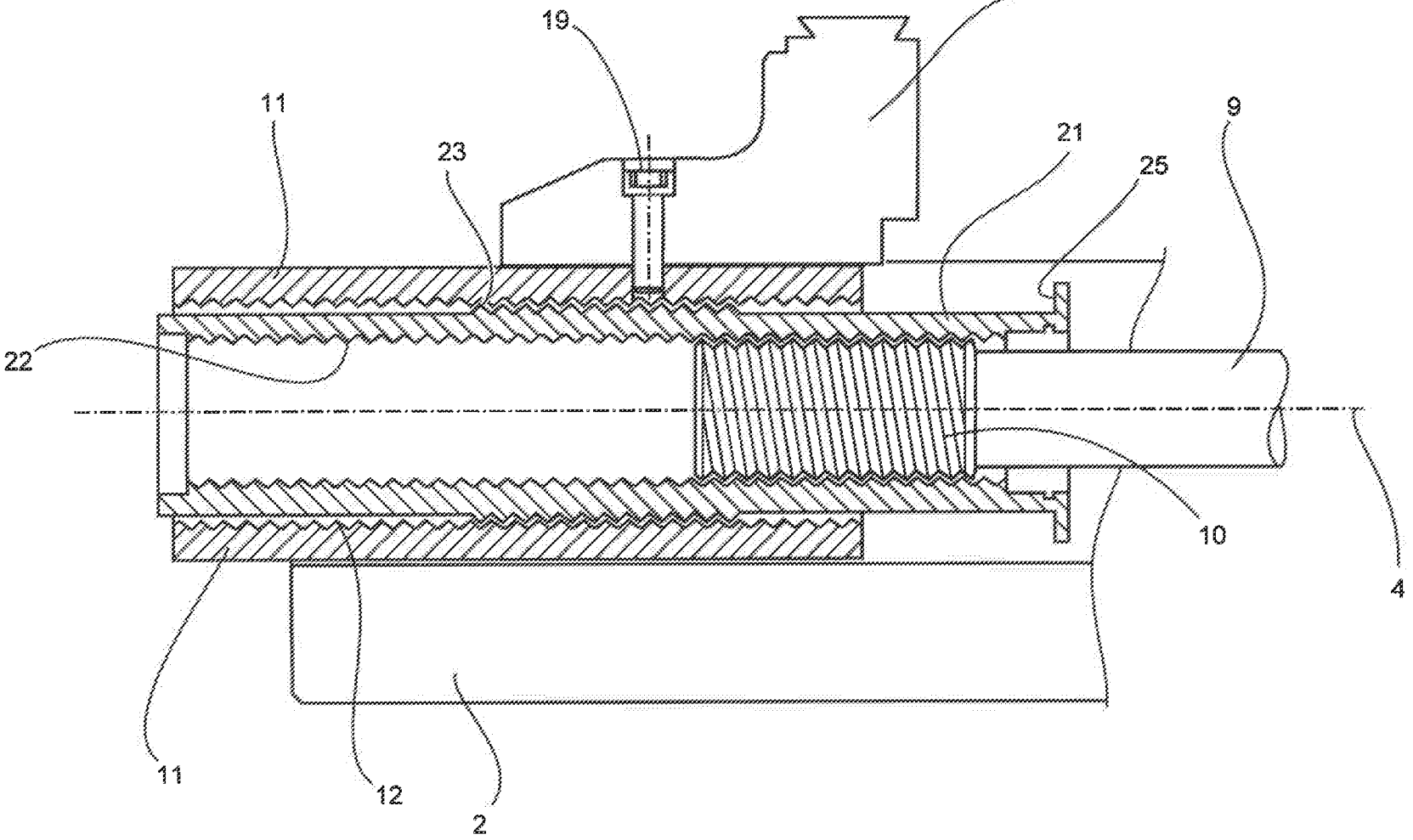
FIG. 5 shows the clamping device according to FIG. 3*a*, in an enlarged section.

FIGS. 4 and 5 show the configuration and allocation of the existing coupling of the thread pairs between the drive spindle 9 and the cover sleeve 21 on the one hand and the cover sleeve 21 and the base jaw 11 on the other hand, which is required for power transmission. The rotation of the drive spindle 9 is converted into a synchronous feed movement of the cover sleeves 21 towards each other or vice versa due to the opposite pitch directions of the thread 10 incorporated into it. Each of the thread pairs 10 and 22 or 23 and 12 has in common that their direction of rotation is right-handed or left-handed, i.e. identical.

Figure 6A:
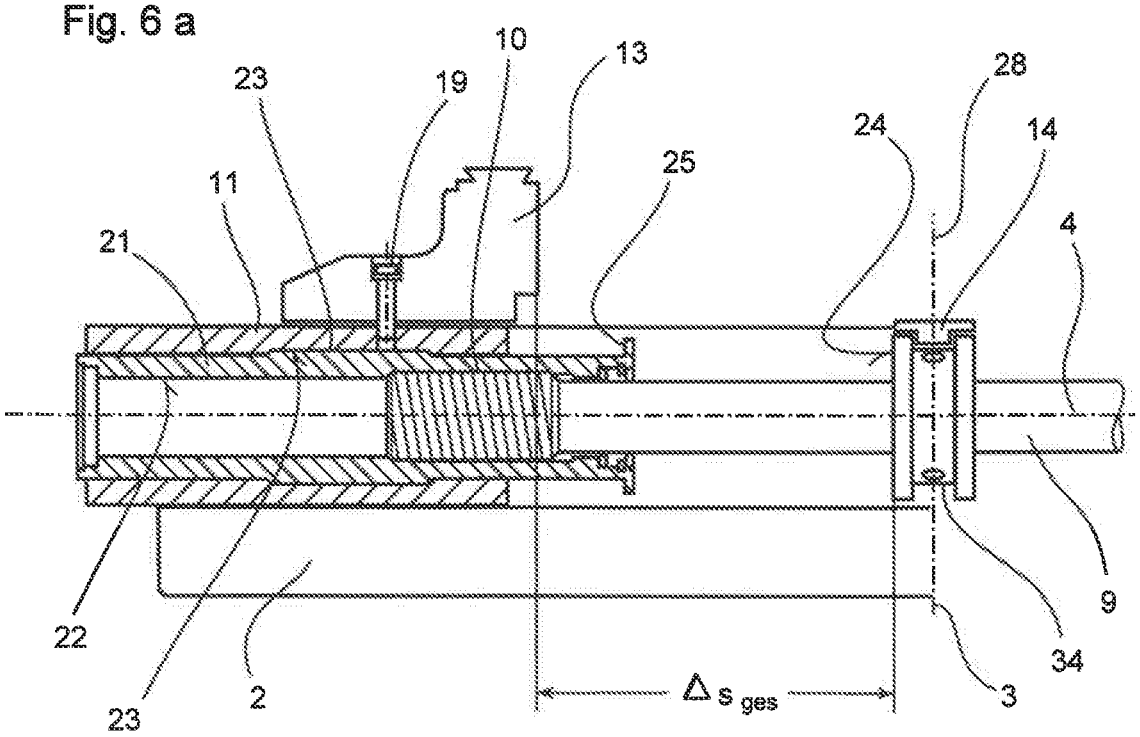
FIG. 6*a* shows the clamping device according to FIG. 1, in the initial position.

FIGS. 6*a*, 6*b*, 6*c* and 6*d* now show the movement of the cover sleeve 21 and the base jaws 11 mechanically coupled to it and the clamping jaws 13 attached to them. The initial position shown in FIG. 6*a* is characterised in that the cover sleeve 21 protrudes telescopically beyond the free end of the drive spindle 9 and the thread 10 of the drive spindle 9 is completely enclosed by the cover sleeve 21. The distance between the cover sleeve 21 and the retaining ring 24 is the largest and is marked Δs. The base jaw 11 also has the largest possible distance from the retaining ring 24, which is assigned to the clamping centre or the central axis 3.

If the drive spindle 9 is now set in rotation by means of the crank 18, the two cover sleeves 21 first move in the direction of the retaining ring 24 via the respective thread pairs 10 and 22, since the rotation of the cover sleeve 21 is fixed by the base jaw 11 and consequently the torque provided by the drive spindle 9 is converted into a linear movement of the cover sleeve 21 and the base jaw 11.

The synchronous feed movements of the cover sleeves 21 and the base jaws 11 towards and in the direction of the central axis 3 are achieved by the fact that the pitches of the opposite threads 10, 12, 22 and 23 are identical; thus the rotational speed of the drive spindle 9 is converted into a linear feed speed of equal magnitude.

Figure 6B:
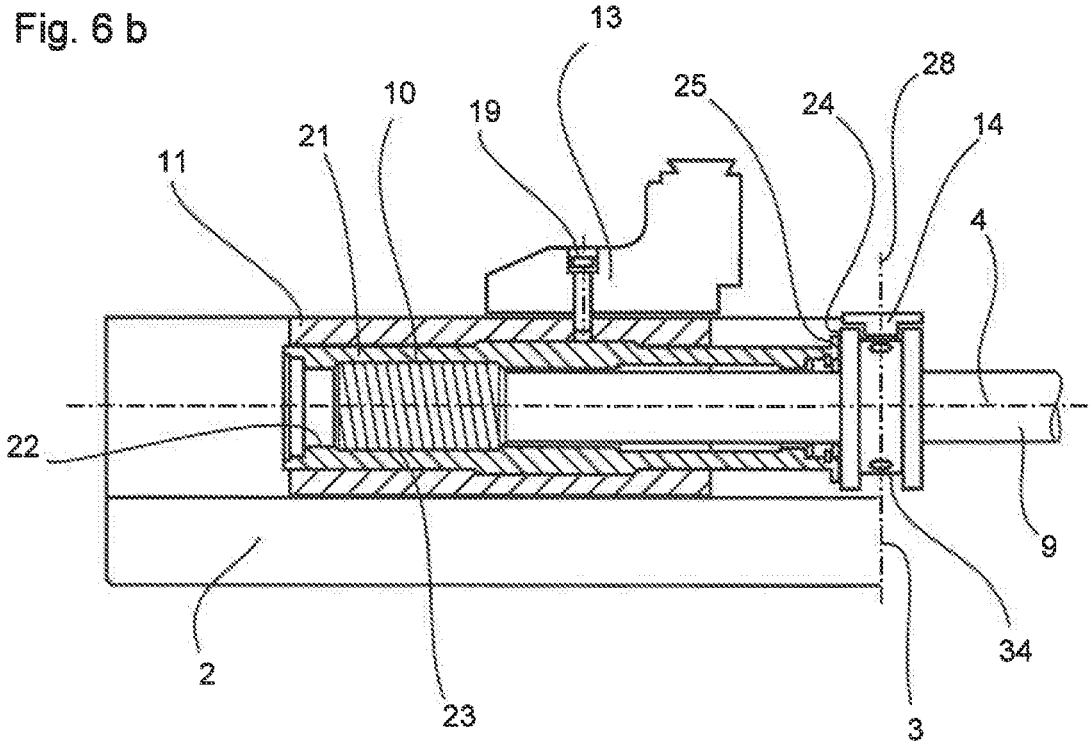
FIG. 6*b* shows the clamping device according to FIG. 1, in an intermediate position, with the cover sleeve resting against the stop.

As soon as the cover sleeve 21 is in contact with the retaining ring 24 of the drive spindle 9 as shown in FIG. 6*b*, it can no longer be moved linearly. The cover sleeve 21 is now fixed to the retaining ring 24 and can no longer move relative to the drive spindle 9, so that the rotation of the drive spindle 9 can be transferred to the drive sleeve 21 via the thread pairs 10 and 22 in such a way that the cover sleeve 21 now moves at the same rotational speed as the drive spindle 9. Since the base jaw 11 is held rotationally fixed in the guideways 8 and consequently no rotational movement can take place, the rotation of the cover sleeve 21 is transmitted to the base jaw 11 via the thread pairs 23 and 12, as a result of which this is moved linearly in the direction of the retaining ring 24.

Figure 6C:
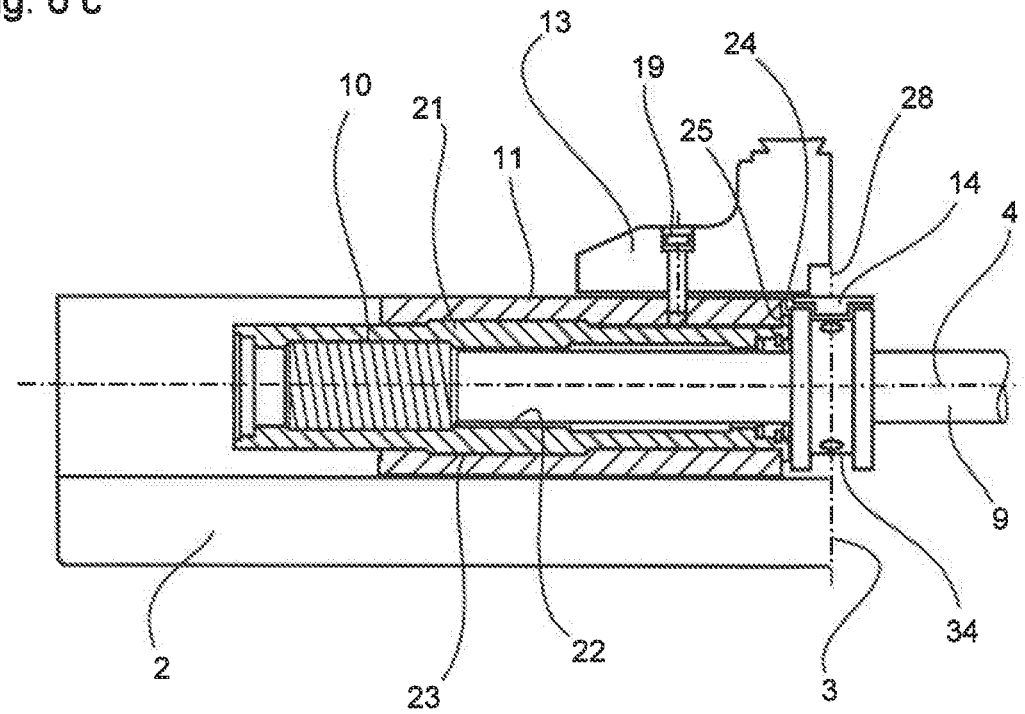
FIG. 6*c* shows the clamping device according to FIG. 1, in a maximum end position.

At the free end of the cover sleeve 21, which faces the retaining ring 24, a ring-shaped stop 25 branches off, which projects radially outwards. FIG. 6*c* shows that the adjustment travel of the base jaw 13 is limited by this stop 25, because the base jaw 13 rests against the stop 25 so that the base surface provided on the clamping jaw 13 is aligned with the longitudinal central axis 3. The two opposite clamping jaws 13 therefore touch each other in this position.

Figure 6D:
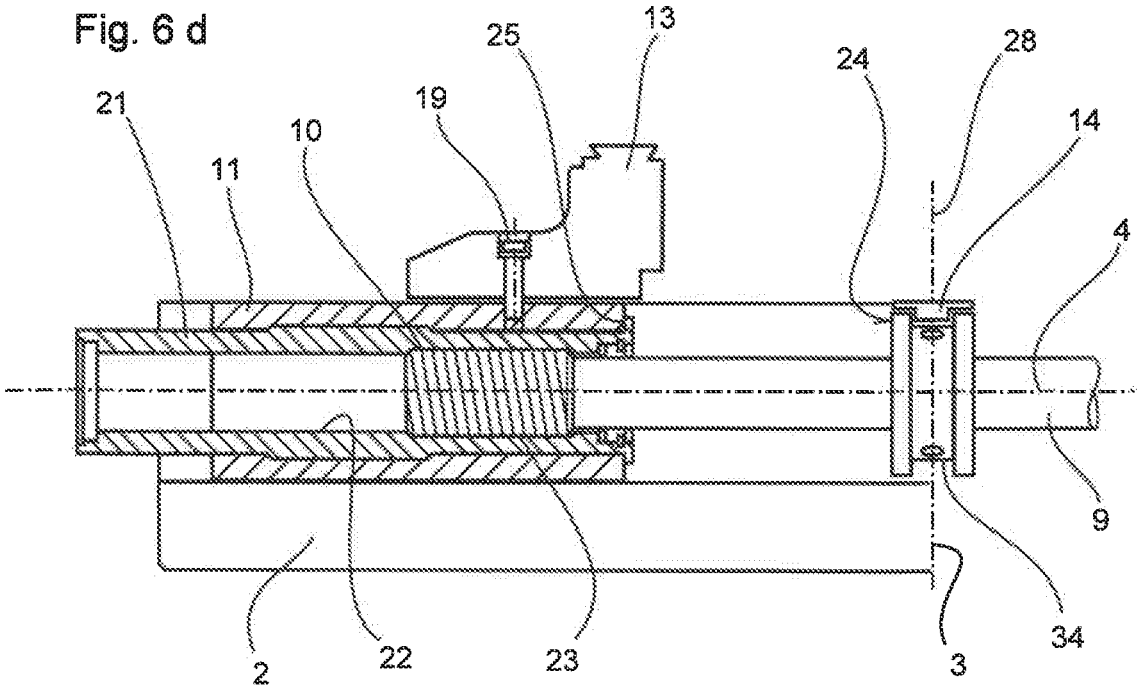
FIG. 6*d* shows the clamping devices according to FIG. 1, with the jaws returned to their initial position.
Figure 7:
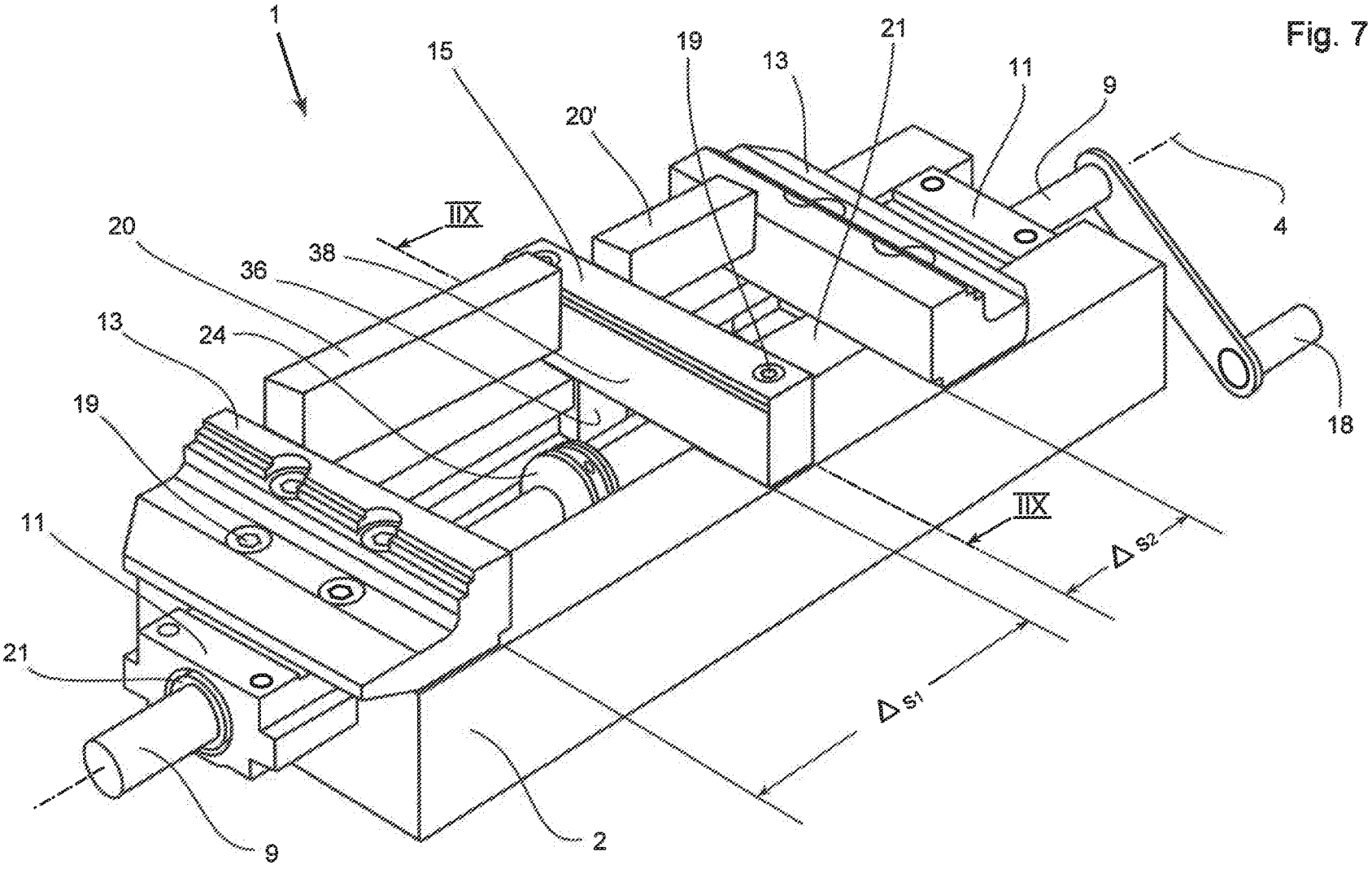
FIG. 7 shows a second application of a clamping device according to FIG. 1, with a stop attached to the housing.
Figure 8:
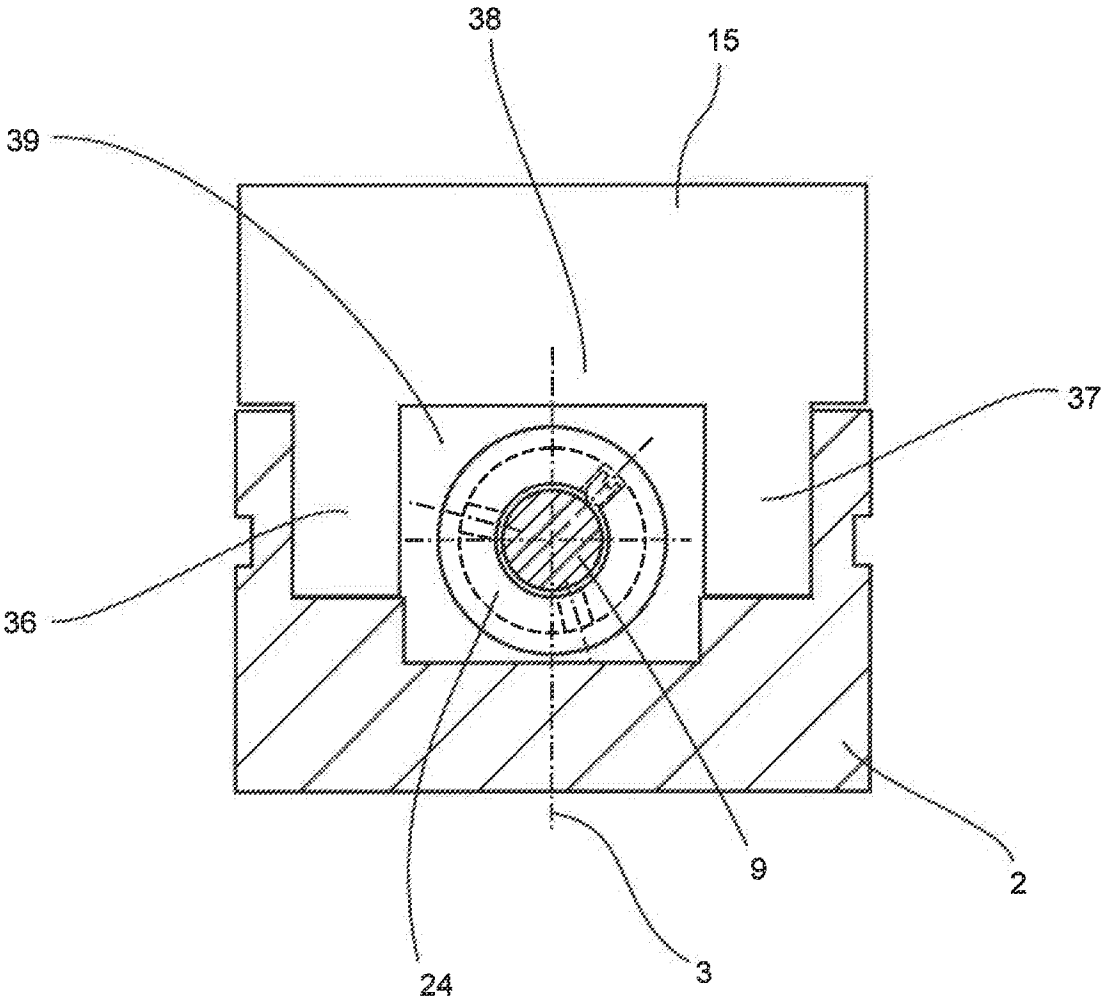
FIG. 8 shows a section through the stop according to FIG. 7 along the section line IIX-IIX.

To move the clamping jaws 13 apart from each other as shown in FIG. 6*d*, the base jaw 11 is first moved by rotation of the drive spindle 9 and thus also of the cover sleeve 21 in opposite directions. If the drive spindle 9 is turned in the opposite direction by the crank 18, the respective cover sleeve 21 is first moved away from the retaining ring 24. As soon as the cover sleeve 21 has reached the end of its internal thread 22, the cover sleeve 21 rotates at the identical rotational speed of the drive spindle 9, creating a rotary movement in the thread 12 of the respective base jaw 11. Accordingly, the base jaw 11 moves back to its initial position and the two opposite clamping jaws 13 are furthest apart. The reset of the base jaw 11 and the cover sleeves 21 is therefore the reverse of their infeed movements.

FIGS. 7, 8, 9*a* and 9*b* show a further application of the clamping device 1 according to the present invention. First, the fixing block 14 is replaced by a stop 15 fixed to the housing 2. The cross section of the stop 15 has a U-shaped contour. The two parallel legs of the stop 15 are marked with the reference numbers 36 and 37 and the web between them is marked with the reference number 38. In contrast to the legs 31, 32 and the web 33 of the fixing block 14, the legs 36, 37 and 38 of the stop 15 are at a distance from the retaining ring 14. Thus, the linear movement of the retaining ring 14 and of the drive spindle 9 is not blocked by the stop 15, but rather released. This means that the air gap 39 between the legs 36, 37 and the web 38 of the stop 15 releases the linear movement of the drive spindle 9 or does not fix it. The position of the drive spindle 9 can therefore be shifted relative to the longitudinal axis 4 of the housing 2. In addition, the stop 15, in particular its web 38, projects into the clamping range of the clamping jaws 13, which is divided into two clamping sections.

Figure 9A:
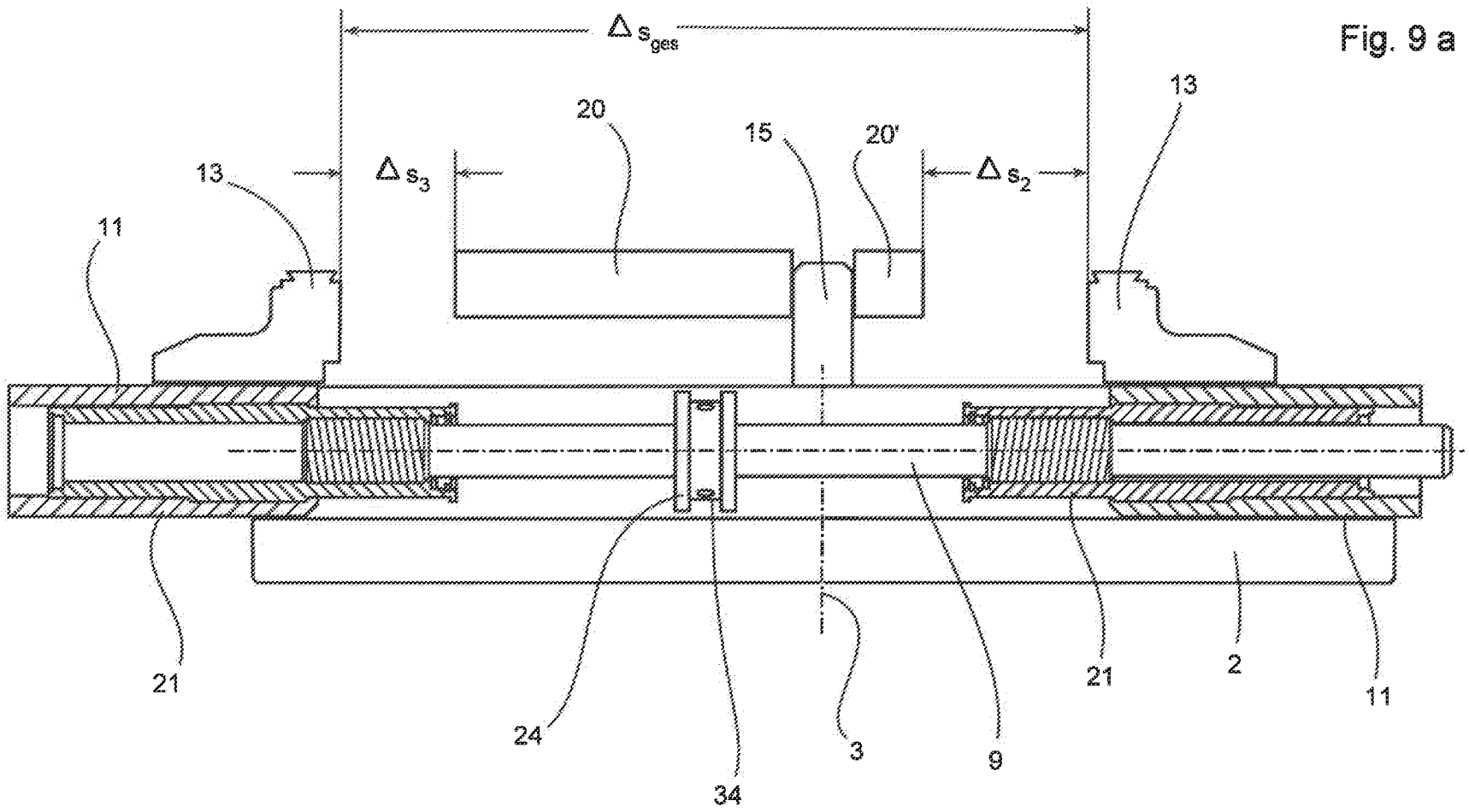
FIG. 9*a* shows the application of the clamping device according to FIG. 7, in the initial position.
Figure 9B:
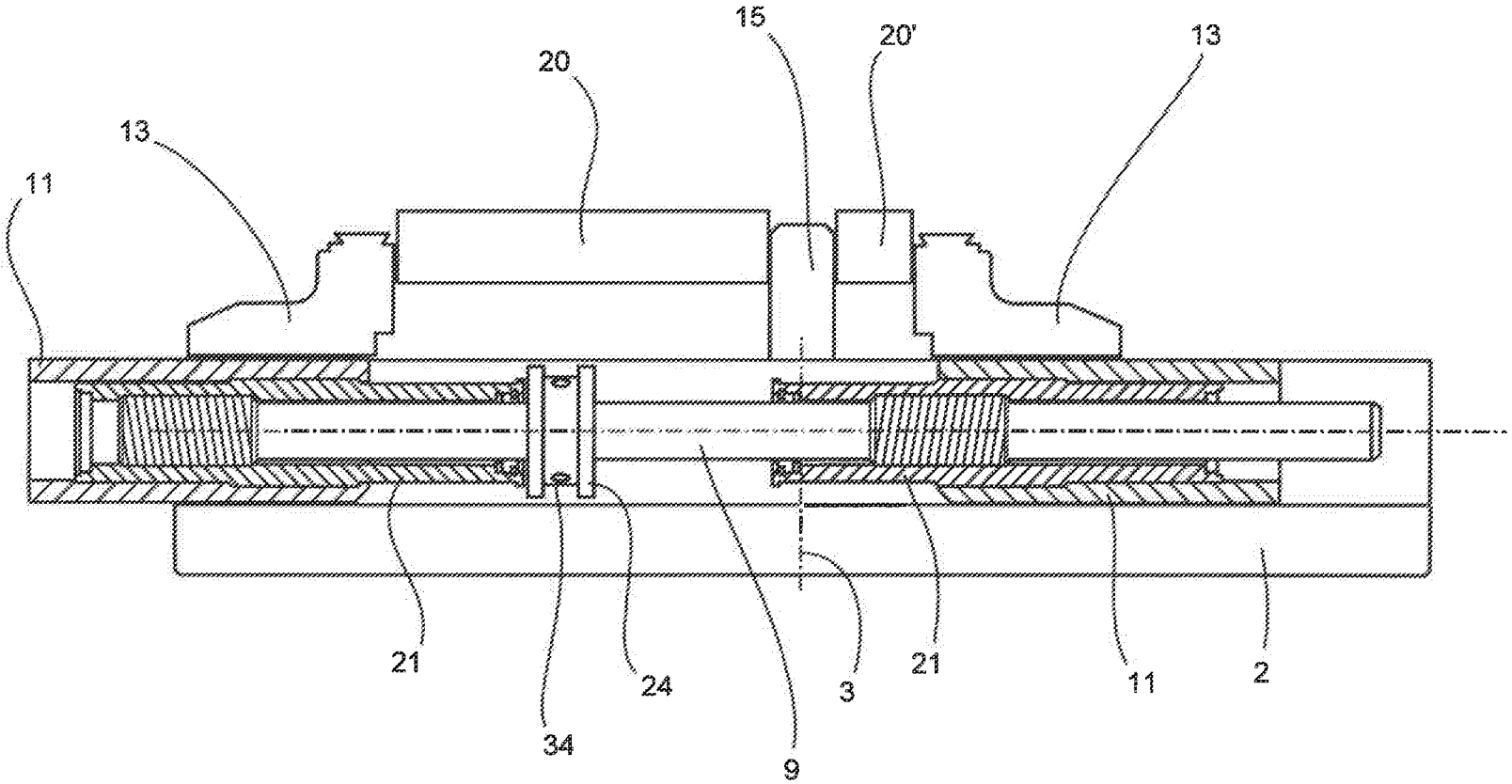
FIG. 9*b* shows the application of the clamping device according to FIG. 7, in the clamping position.

As can be seen in FIGS. 9*a* and 9*b* in particular, a workpiece 20 of different lengths can be clamped between the stop 15 and the adjacent clamping jaw 13, since the different lengths of the workpieces 20 can be compensated by the relative position of the drive spindle.

As soon as the clamping jaw 13, which faces the longer workpiece 20, comes into contact with it, its base jaw 11 is fixed and the drive spindle 9 can be moved further relatively due to the telescopic cantilever of the cover sleeve 21. As a result, the central axis 3 and the axis of symmetry 34 of the retaining ring 24 are at a distance from one another. The clamping jaw 13 facing the smaller workpiece 20 can be fed in the direction of the smaller workpiece 20 to be clamped for as long as this situation continues, or until it is fixed between the stop 15 and the clamping jaw 13 in a position-oriented manner. This position of the two differently sized workpieces 20 on the clamping device 1 according to the present invention is shown in FIG. 9*b*.

Figure 10:
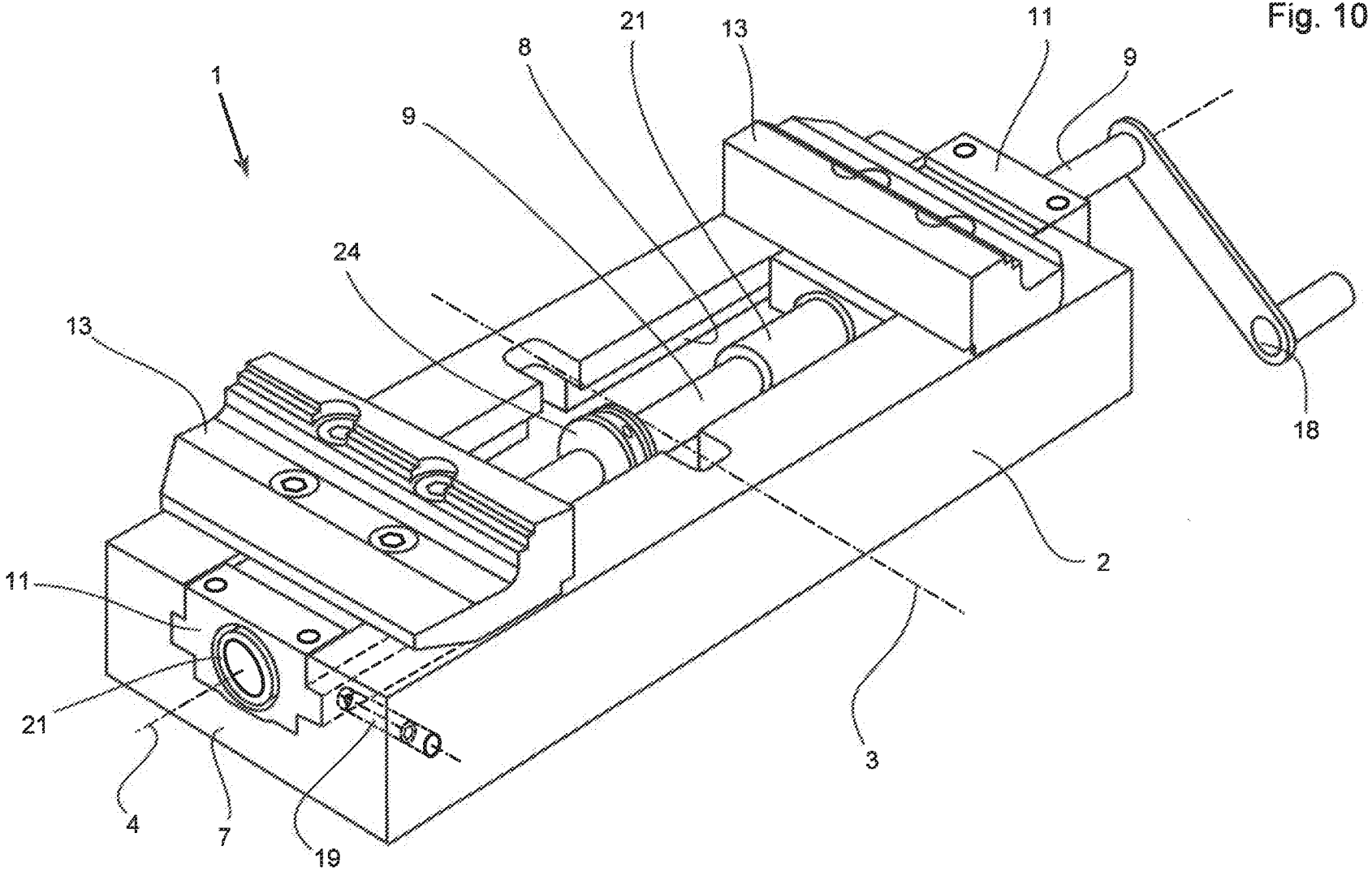
FIG. 10 shows a third application of the clamping device according to FIG. 1, with a base jaw fixed to the housing, in perspective view.

Another advantageous application of the clamping device 1 according to the present invention is shown in FIG. 10. There, the base jaw 11 facing away from the crank 18 is fixed to the housing 2 by means of the fastening screws 19. Consequently, this base jaw 11 cannot move relatively in the direction of the longitudinal axis 4 of the housing 2 and the clamping jaw 13 fixed to this serves exclusively as a stop. The opposite base jaw 11 can be configured up to the fixed base jaw 11 or clamping jaw 13, since the relative position of the drive spindle can be shifted relative to the housing 2. The free end of the drive spindle 9 opposite the crank 18 can emerge from the housing 2 or be turned out of it.

The clamping device 1 according to the invention can thus provide for three completely different clamping situations without the respective users of the clamping device 1 having to carry out time-consuming and complicated conversion work. At the same time, the thread pairs 10 and 22 on the one hand and 23 and 12 on the other hand are permanently enclosed so that impurities in the form of chips, hydraulic fluids or the like cannot penetrate these threads 30.

The vice 1 according to the present invention can therefore be used for different clamping situations without time-consuming and complicated conversion measures. The drive spindle 9 can be fixed on the one hand by the fixing block 14 and on the other hand can be shifted freely along the longitudinal axis 4 of the housing 2 via the central axis 3. This means that both the guideways 8 and the drive spindle 9 as well as the cover sleeves 21 can emerge from the planes formed by the ends of the housing 2. Accordingly, the freedom of movement of the drive spindle 9, the base jaws 11 and the cover sleeves 21 is completely released by the housing 2.

Several distance rings 16 are installed between the drive spindle 9 and the base jaw 11 or the housing 2, by means of which on the one hand the drive spindle 9 can be buffered in the direction of the longitudinal axis 4 and on the other hand can be fixed in this direction as soon as one of the distance rings 16 comes into releasable contact or engagement with both the drive spindle 9 and the base jaw 11 or the housing 2.

What is claimed is:

1. A clamping device (1) comprising:

a housing (2) having a longitudinal axis (4), the housing (2) comprising a U-shaped cross-section and at least one guideway (8) extending parallel to the longitudinal axis (4) of the housing (2);

at least one base jaw (11) mounted in the at least one guideway (8), the at least one base jaw (11) comprising a base jaw thread (12) extending about a portion of the at least one base jaw (11);

a drive spindle (9) rotatably mounted in housing (2) parallel to the at least one guideway (8), the drive spindle (9) comprising at least one spindle thread region (10), wherein the thread in the at least one spindle thread region (10) extends about the drive spindle (9); and at least one cover sleeve (21), the at least one cover sleeve (21) comprising a sidewall which defines an exterior surface and an interior surface, the at least one cover sleeve (21) further comprising:

an internal threaded region (22) formed on the interior surface of the sidewall of the at least one cover sleeve (21); and an external threaded region (23) formed on the exterior of the sidewall of the at least one cover sleeve (21);

wherein the at least one spindle thread region of the drive spindle (9) is configured such that when the at least one spindle thread region (10) of the drive spindle is fully engaged with the internal threaded region (22) formed on the sidewall of the at least one cover sleeve (21), rotation of the drive spindle (9) effects rotation of the at least one cover sleeve (21); and wherein, when the at least one cover sleeve (21) rotates, the external threaded region (23) on the exterior of the sidewall of the at least one cover sleeve (21) engages the base jaw thread (12) of the at least one base jaw (11), whereby to move the at least one base jaw (11) in a first longitudinal direction when the drive spindle is rotated in a first rotational direction, and whereby to move the at least one base jaw (11) in a second longitudinal direction when the drive spindle is rotated in a second rotational direction, and wherein the second longitudinal direction is the opposite of the first longitudinal direction.

2. The clamping device according to claim 1, wherein, the at least one base jaw (11) is locked against movement relative to the housing (2) by means of at least one fastening screw (19).

3. The clamping device according to claim 1, wherein, the internal threaded region (22) and the external threaded region (23) of the at least one cover sleeve (21) are arranged such that the internal threaded region (22) is spatially offset from the external threaded region (23).

4. The clamping device according to claim 1, wherein, the length of the at least one cover sleeve (21) is greater than the length of the at least one spindle thread region (10) of the drive spindle (9).

5. The clamping device according to claim 1, wherein, the at least one guideway (8) and/or the at least one base jaw (11) are open at respective outer end faces of the housing (2) such that the at least one base jaw (11) and/or the drive spindle (9) and/or the at least one cover sleeve (21) project from or beyond the housing (2).

6. The clamping device according to claim 1, wherein, the clamping device further comprises at least one clamping jaw (13) configured to be fastened to the at least one base jaw (11) in a plurality of different positions.

7. The clamping device according to claim 6, wherein, two cover sleeves (21) are aligned or arranged flush with one another or coaxially with the longitudinal axis (4) of the housing (2).

8. The clamping device according to claim 1, wherein, a stop (15) having a U-shaped cross-section is provided between two base jaws (11), and wherein the stop (15) is fastened to the housing (2), and further wherein the drive spindle (9) engages through the stop (15).

9. The clamping device according to claim 8, wherein, the stop (15) is formed from two legs (36, 37) running parallel to one another and a web (38) arranged between them, and wherein the inner walls of the legs (36, 37) and of the web (38) are spaced apart from the outer circumference of a retaining ring (24) mounted to the drive spindle (9) such that there is an air gap (39) between them.

10. The clamping device according to claim 9, wherein, the web (38) of the stop (15) projects out of the housing (2), whereby to divide a first clamping region of a clamping jaw (13) mounted to a first base jaw (11) from a second clamping region of a clamping jaw (13) mounted to a second base jaw (11).

11. The clamping device according to claim 1, wherein the clamping device further comprises:

a retaining ring (24) mounted to the drive spindle (9);

a fixing block (14) releasably locked to the housing (2), wherein the cross-section of the fixing block is U-shaped, and further wherein the fixing block (14) comprises two legs (31, 32) running parallel to one another, and a web (33) aligned perpendicularly to the two legs; and a circumferential groove (34) worked into the retaining ring (24);

wherein the two legs (31, 32) and the web (33) are configured to engage in the groove (34), whereby to fix the fixing block in the longitudinal direction (4).

12. The clamping device according to claim 11, wherein, the web (33) is in alignment with a surface of the housing (2).

13. The clamping device according to claim 11, wherein, the retaining ring (24) has a circumferential axis of symmetry (28) which runs in the center of the groove (34), and the distance of the axis of symmetry (28) from the beginning of the at least one spindle thread region (10) of the drive spindle (9) is in each case identical in the assembled state of the retaining ring (24).

14. The clamping device according to claim 11, wherein, the adjustment travel ($\Delta s$) of the at least one cover sleeve (21) relative to the drive spindle (9) is limited in the direction of a central axis (3) of the housing (2).

* * * * *